United States Patent [19]

Zito

[11] 4,109,907

[45] Aug. 29, 1978

[54] WEIGHT LIFTING APPARATUS

[76] Inventor: Anthony A. Zito, Hays Mill Rd., Atco, N.J. 08004

[21] Appl. No.: 725,047

[22] Filed: Sep. 20, 1976

[51] Int. Cl.[2] ..... A63B 21/06

[52] U.S. Cl. ..... 272/117; 272/DIG. 5

[58] Field of Search ..... 272/117, 120, 116, 118, 272/121, 143; 248/228, 72, 100, 95; 108/151; 128/275

[56] References Cited

U.S. PATENT DOCUMENTS

| | | | |
|---|---|---|---|
| 963,890 | 7/1910 | Haas | 272/117 X |
| 2,918,282 | 12/1959 | Waterval | 272/117 |
| 3,115,339 | 12/1963 | Forte | 272/117 |
| 3,200,536 | 8/1965 | Petitto | 272/116 X |
| 3,858,874 | 1/1975 | Weider | 272/121 |

*Primary Examiner*—William R. Browne

*Attorney, Agent, or Firm*—Robert K. Youtie

[57] ABSTRACT

A home weight lifting exercise device including clips for engagement over the upper edge of a door. Each of the clips has an outstanding flange. A pulley is suspended from each flange. A cord is reeved over each pulley. On an end of each cord there is positioned a hand loop to be grasped by a user. On the opposite ends of each cord is a weighted bag. There is a releasable fastener device on each bag to detachably connect it with its associated cord. A head support is removably connected to the hand loops.

2 Claims, 4 Drawing Figures

FIG. 1
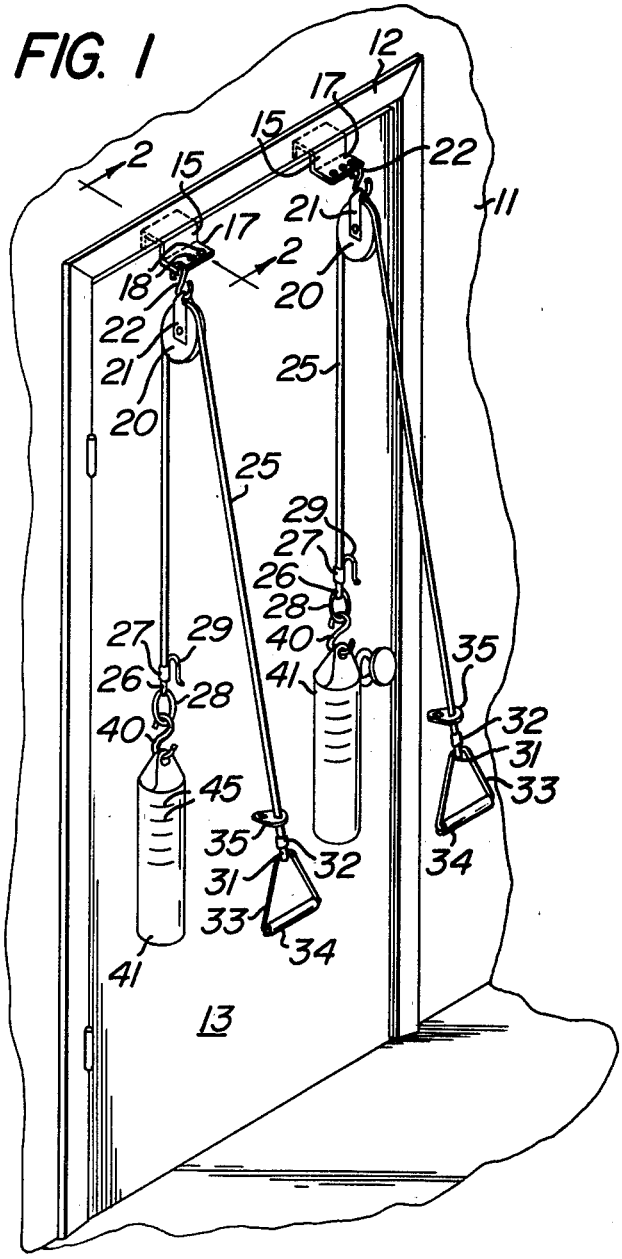
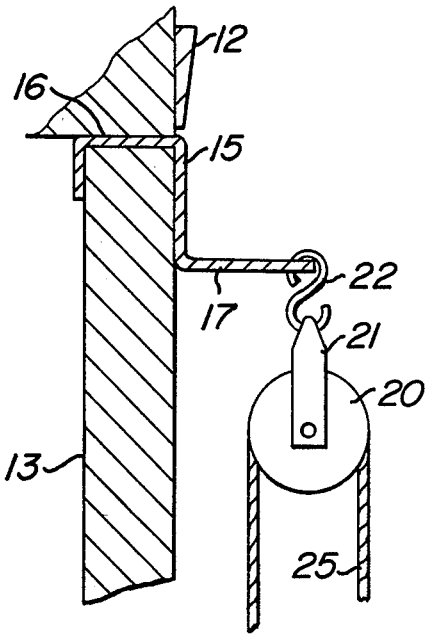
FIG. 2
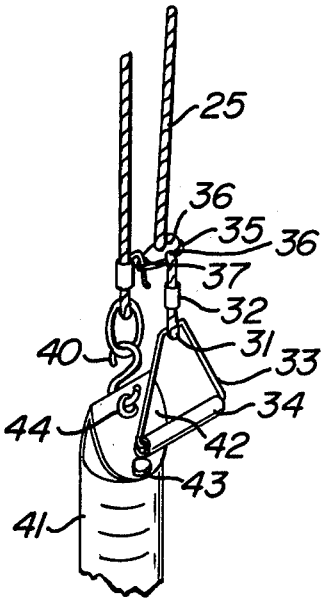
FIG. 3
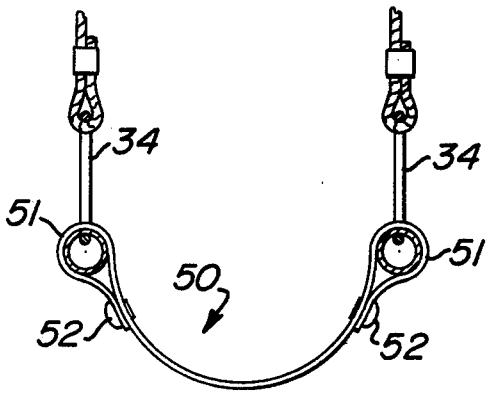
FIG. 4

WEIGHT LIFTING APPARATUS

BACKGROUND OF THE INVENTION

As is well known to those versed in the art, there have been provided a number of prior exercise devices having block-and-tackle means associated with weights and handgrips for various manipulation against the weights to accomplish desired exercises.

However, prior exercise devices have not enabled the user to advantageously employ the weights to aid in body exercises, rather than resist. Further, prior exercise devices have not been useful in performing certain very popular exercises, such as sit-ups, push-ups, and variations thereof, which exercises are highly beneficial in reducing waist dimensions, while building upper torso dimensions.

SUMMARY OF THE INVENTION

Accordingly, it is an important object of the present invention to provide a unique home exercise device which enables a user to employ weights in aiding, rather than resisting, body movements, so that the exercises may be continued for relatively long periods without undue exhaustion, and which further specifically enables a user to perform relatively great numbers of sit-ups and push-ups without having great strength and endurance, so as to achieve the advantageous results thereof.

It is still another object of the present invention to provide a home exercise device having the advantageous characteristics mentioned in the preceding paragraph, which is extremely simple in construction, for economy in manufacture and sale at a reasonable price, adapted for collapse and storage in relatively little space and being capable of quick and easy setup on a conventional household door.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a home exercise device constructed in accordance with the teachings of the present invention, as applied to a domestic door.

FIG. 2 is a partial sectional elevational view taken generally along the line 2—2 of FIG. 1.

FIG. 3 is a partial perspective view showing a nonuse condition.

FIG. 4 is a partial sectional view showing a preferred embodiment.

DESCRIPTION OF THE PREFERRED EMBODIMENTS

Referring now more particularly to the drawings, and specifically to FIG. 1 thereof, there is shown a conventional building construction including a wall 11, being provided therein with a doorway 12, including a door 13 in the doorway.

The home exercise device is shown in position on the door 13, and may include a pair of inverted, generally U-shaped mounting brackets or clips located in spaced relation and conformably engaged over the upper edge 16 of door 13. Outstanding from one end of each clip 15 is an extension or flange 17. The clips 15 may be substantially identical, and may be fabricated of sheet metal, or other suitable material, the flanges 17 outstanding generally horizontally from the door 13 in the use condition. Each flange is provided along its outer edge with one or more apertures 18, being shown in the illustrated embodiment as a row of three apertures 18, see FIG. 1.

A pulley 20 is associated with each clip 15, including a hanger or strap 21, and a suspension member or S-shaped hook 22 suspending the respective pulley from the adjacent flange 17. That is, each S-shaped hook 22 may have one end engaged through one hole 18 of one flange 17, depending therefrom with its lower end engaged through mounting part or strap 21 of the adjacent pulley.

Trained over each pulley 20 is a flexible, elongate tension member, rope or cord 25. One end region of cord 25 may be doubled back to form a loop, as at 26, the doubled portion secured together by any means, such as a clinching member or collar 27. Each loop 26 may be provided with an annular end member or ring 28 extending through the respective loop; and, each collar, cinch or clamp 27 may further embrace an additional hook 29, which faces downwardly in the operative condition of FIG. 1, for a purpose appearing presently.

On the other end of each rope or cord 25, there may similarly be formed a loop 31, defined by a clamping collar 32. A handgrip, ring or loop 33 may extend through each cord loop 31, say of triangular formation as illustrated, or other suitable configuration, and may be provided on one side with a tubular handgrip 34. In addition, each cord 25, adjacent to its hand loop 33, may be provided with a retainer 35. The retainers 35 may each be defined by a plate, as best seen in FIG. 3 having a pair of through openings 36, through which is threaded the cord 25. Further, each retaining member or plate 35 includes an additional through aperture or hole 37, which releasably receives the adjacent hook 29, for a purpose appearing presently.

Removably carried by each ring or eye 28, may be an additional S-shaped hook or suspension member, from which depends a weighted container or bag 41. Specifically, the bag 41 may each be fabricated of any suitable flexible sheet material, and provided at its upper end with a closure flap 42 removably secured in closed relation by any suitable fastener means 43, such as snap fastener means. The closure flap 42 is provided with grommets or eyelets 44 which receive the lower end of hook 40 to suspend the bag 41 from the cord 25. The bag may be filled with any suitable means, such as sand, shot or other, to acquire the desired weight, and suitable indicia or markings may be provided on the bags, as at 45 to indicate the level of contents corresponding to a desired weight.

In operation, it will be apparent that a user may grasp the handholds 34 in respective hands and perform various manipulations to achieve the desired results while working against the weights of bags 41. For a convenient nonuse condition, without removal of the exercise device from the door 13, the hooks 29 may be engaged through respective retainer openings 37 to minimize free swinging of the handloops 34 upon door movement. Of course, it is quite simple to remove and replace the entire exercise device, merely requiring upward movement of the clips 15 from the upper door edge 16, and replacement, as desired.

In accordance with the teachings of the present invention, there is provided a flexible support member or strap 50 removably extendable between the pair of handholds 34, see FIG. 4. The support or strap 50 may include opposite end portions 51 extending through respective handholds 34 and detachably secured in interlooped relation with respective handholds, as by releasable fastener means 52. By this means, the strap 50 may be employed to support one's head, neck, torso, or the like during the performance of various exercises to utilize the weight of bags 41 in elevating body parts. For example, a user laying back downwardly upon the floor may support the head or neck in the strap 50, whereby the weights 41 may serve to raise the torso during sit-ups. In this manner, persons wishing to take advantage of the slimming effects of sit-ups may perform relatively great numbers of sit-ups, which would otherwise require great strength and endurance. Similarly, the body supporting member or strap 50 may be employed to aid in push-ups, or other desired exercises.

While it is appreciated that the weights of bags 41 may be varied, as desired, by varying the contents thereof, it is also possible to suspend both pulleys 20 from a single clip 15, and grasp both handholds 34 with a single hand, as for rebuilding a single arm, or two units may be employed in association with each clip 15, if desired. Also, rather than a pair of clips 15, there may be substituted a single longer clip, if desired.

From the foregoing, it is seen that the present invention provides a home exercise device which is extremely simple in construction, uniquely enabling advantageous operation and results, capable of quick and easy setup and knockdown for convenient storage, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A home exercise device comprising clip means for removable engagement over the upper edge of a door, flange means outstanding from said clip means and having at least a pair of holes, a pair of hooks for removable engagement through the holes of said flange means, a pair of pulleys suspended from respective hooks, a flexible cord trained over each pulley, a load containing bag removably connected to one end of each cord, a hand loop connected to the other end of each cord for hand manipulation of said loops against the weight of said bags, and a head support extending removably between said hand loops for supporting the user's head in various body movement, said bags each being fabricated of flexible sheet material and including an upper end flap swingable into and out of overlying relation with its respective bag, and releasable fastener means on each bag and its flap to releasably retain the latter in its overlying relation to define an eye for detachable connection to the associated cord, additional hooks connecting each bag to its associated cord, and a retaining eye on each cord adjacent to its hand loop for releasable connection to the additional hook of the associated cord for convenient storage and portability.

2. A home exercise device according to claim 1, said bags having filling indicia for achieving desired bag weight.

* * * * *